US006087905A

United States Patent [19]

Makino et al.

[11] Patent Number: 6,087,905

[45] Date of Patent: Jul. 11, 2000

[54] NONRECIPROCAL CIRCUIT DEVICE HAVING A LOW-PASS FILTER FORMED ON A SPACER

[75] Inventors: Toshihiro Makino, Matto; Takashi Kawanami, Ishikawa-ken; Takashi Hasegawa, Kanazawa, all of Japan

[73] Assignee: Murata Manufacturing Co., Ltd., Japan

[21] Appl. No.: 09/261,245

[22] Filed: Mar. 3, 1999

[30] Foreign Application Priority Data

Mar. 4, 1998 [JP] Japan ..... 10-051926

[51] Int. Cl.[7] ..... H01P 1/383

[52] U.S. Cl. ..... 333/1.1; 333/24.2

[58] Field of Search ..... 333/1.1, 24.2

[56] References Cited

U.S. PATENT DOCUMENTS

| | | | |
|---|---|---|---|
| 3,935,549 | 1/1976 | Jachowski | 333/1.1 |
| 5,923,224 | 7/1999 | Makino et al. | 333/1.1 |
| 6,020,793 | 2/2000 | Makino et al. | 333/1.1 |

FOREIGN PATENT DOCUMENTS

| | | | |
|---|---|---|---|
| 3006387 | 8/1981 | Germany . | |
| 3525828 | 1/1987 | Germany . | |
| 56-24815 | 3/1981 | Japan | 333/1.1 |
| 255403 | 2/1990 | Japan . | |

OTHER PUBLICATIONS

Patent Abstracts Of Japan, vol. 14, No. 222 (3–926), May 10, 1990 & JP 02 055403 A (Murata Mfg. Co. Ltd.), Feb. 23, 1990, abstract.

European Search Report dated Jun. 9, 1999.

*Primary Examiner*—Paul Gensler

*Attorney, Agent, or Firm*—Ostrolenk, Faber, Gerb & Soffen, LLP

[57] ABSTRACT

A nonreciprocal circuit device which can achieve miniaturization and cost reduction by increasing attenuation outside a passband and greatly decreasing the occurrence of extraneous radiation emissions. The nonreciprocal circuit device comprises: a magnetic circuit comprising a permanent magnet disposed in a yoke; a magnetic member; a magnetic assembly disposed in the magnetic circuit and having a plurality of central conductors disposed on the magnetic member so as to mutually intersect; a plurality of matching capacitors connected respectively between a port of each of the central conductors and a ground terminal; a resin case containing the magnetic assembly and the matching capacitors and having an input/output terminal and said ground terminal; and a spacer for stably supporting at least the magnetic assembly and the matching capacitors in the case; wherein the spacer includes a filter inductor and a filter capacitor; the filter inductor is connected between said port of one of the central conductors and an input/output terminal corresponding to the port; the filter capacitor is connected between said input/output terminal and said ground; whereby a low-pass filter is formed by the filter inductor, the filter capacitor, and the matching capacitor.

13 Claims, 8 Drawing Sheets

NONRECIPROCAL CIRCUIT DEVICE HAVING A LOW-PASS FILTER FORMED ON A SPACER

BACKGROUND OF THE INVENTION

1. Field of the Invention

The present invention relates to a nonreciprocal circuit device such as an isolator, a circulator, etc., which is employed for a high-frequency band, for example, a microwave band. More particularly, the invention relates to a nonreciprocal circuit device, which can achieve miniaturization and cost reduction when the device is used in mobile communication equipment.

2. Description of the Related Art

In general, a nonreciprocal circuit device such as a lumped-constant type isolator or circulator has characteristics in which the amount of attenuation of signals is extremely small in the direction along which signals are transmitted, whereas it is extremely large in the opposite direction. A conventional type of such an isolator includes a device having a structure shown in FIG. 7. The conventional isolator has a structure in which components including a permanent magnet 3; a spacer 14; a magnetic assembly 5 comprising three central conductors 51, 52, and 53, and a ferrite member 54; and a resin case 7 are arranged in a closed magnetic circuit formed primarily by an upper yoke 2 and a lower yoke 8. Ports P1 and P2 of the central conductors 51 and 52 are respectively connected to input/output terminals 71 and 72 and matching capacitors Co which are disposed in the resin case 7; a port P3 of the central conductor 53 is connected to another matching capacitor Co and a terminal resistor R; and an end of each matching capacitor Co and an end of the terminal resistor R are respectively connected to ground terminals 73.

The spacer 14 is disposed between the permanent magnet 3 and the magnetic assembly 5, and the upper yoke 2 is fitted into the lower yoke 8. In this state, the magnetic assembly 5 and a resin case 7 are pressed and secured into the lower yoke 8; the matching capacitors Co and the terminal resistor R are secured into the resin case 7; and the ports P1 to P3 of the respective central conductors 51 to 53 are secured to the matching capacitors Co, the terminal resistor R, and the input/output terminals 71 and 72, which are arranged in the resin case 7. In other words, the spacer 14 is used to fill in the space inside the nonreciprocal circuit device so as to achieve stable fixing of the components arranged in the nonreciprocal circuit device, for instance, the magnetic assembly 5, the matching capacitors Co, the terminal resistor R, etc.

FIG. 8 is an equivalent circuit diagram of the conventional isolator described above. As shown in this figure, the arrangement of the isolator is such that the matching capacitors Co are respectively connected to the ports P1 to P3, which are the ends of the central conductors 51 to 53, to form matching circuits and the port P3 is also connected to the terminal resistor R. Each inductor L has equivalent inductance, which is formed of the ferrite member 54 and the central conductors 51 to 53.

This type of isolator is employed in a shared-antenna transmitting/receiving circuit arranged in a mobile communication unit such as a mobile phone, a car cellular phone, etc. In this case, the isolator is surface-mounted on a mounting board comprising the circuit unit.

In general, an amplifier incorporated in such communication equipment has a non-linear characteristic, which causes extraneous radiation emissions (spurious radiation, particularly a second or third harmonic). The extraneous radiation emission is a factor which may trigger malfunctions in power amplifiers of other communication equipment or cause interference; the extraneous radiation emissions should therefore be reduced to be below a certain level.

In addition, since the isolator has a function of a band-pass filter in its transmission direction, attenuation of a signal in a frequency band outside its passband is large even in the transmission direction. However, an isolator is not originally intended for obtaining attenuation outside the passband; thus, the desired amount of attenuation in the frequency band where the extraneous radiation emissions occur (particularly, second and third harmonics) cannot be obtained by the above-described conventional isolator. Therefore, the conventional communication device uses an additional device for reducing extraneous radiation emissions, such as an extra filter, or the like.

Thus, when the conventional isolator is used, a filter for blocking extraneous radiation emissions (spurious emissions) is required. This causes problems in that use of the extra filter leads to increased cost due to the additional component and to increased size of the device. That is, the conventional device cannot meet demands for miniaturization and cost reduction.

SUMMARY OF THE INVENTION

The present invention is able to avoid these problems by providing a nonreciprocal circuit device which can achieve miniaturization and cost reduction by increasing attenuation of signals outside a passband to substantially decrease extraneous radiation emissions.

To this end, according to an aspect of the present invention, there is provided a nonreciprocal circuit device comprising a magnetic assembly having a magnetic member and a plurality of central conductors which are arranged so as to mutually intersect and are adapted to receive a DC magnetic field applied thereto. The plurality of central conductors may be disposed on the magnetic member or may be disposed within the magnetic member (the embodiment which will be described herein shows the former configuration). A matching capacitor is connected between a port of each of the central conductors and ground. A spacer stably supports at least the magnetic assembly and the matching capacitor.

A filter inductor and a filter capacitor are formed on (or in) the spacer; the filter inductor is connected between at least one of the ports of the central conductors and an input/output terminal corresponding to the port; and the filter capacitor is connected between the input/output terminal connected to the filter inductor and ground. A low-pass filter is thereby formed by the filter inductor, the filter capacitor, and the matching capacitor.

According to another aspect of the present invention, there is provided a nonreciprocal circuit device having a magnetic circuit comprising a permanent magnet disposed in a yoke; a magnetic assembly being disposed in the magnetic circuit and having a magnetic member and a plurality of central conductors arranged so as to mutually intersect; a matching capacitor connected between a port of each of the central conductors and ground; a resin case containing the magnetic assembly and the matching capacitors and having input/output terminals and ground terminals; and a spacer supporting stably at least the magnetic assembly and the matching capacitors; wherein a filter inductor and a filter capacitor are formed on the spacer; the filter inductor is connected between at least one of the ports of the central conductors and the input/output terminal corresponding to the port; the filter capacitor is connected between the input/output terminal connected to the filter inductor and ground; whereby a low-pass filter is formed by the filter inductor, the filter capacitor and the matching capacitor.

In the nonreciprocal circuit device of the first or second aspect, the filter inductor and the filter capacitor may be formed by an electrode pattern on a surface of the spacer or inside of the spacer.

According to an advantageous feature of the invention, the low-pass filter may be constructed as follows. An inductor electrode and a first capacitor electrode are formed in series on a surface of the spacer with a first junction therebetween. A second junction is formed at a free end of the first capacitor electrode; and a third junction at a free end of the inductor electrode. On the back of the spacer are formed a second capacitor electrode at a position opposing the first capacitor electrode, a first junction electrode at a position corresponding to said free end of the inductor electrode, and a second junction electrode at a position corresponding to the second junction of the first capacitor electrode; and a second junction is formed at a position corresponding to the first junction connecting the inductor electrode and the first capacitor electrode. A through-hole connects the free end of the inductor electrode and the first junction electrode, and another through-hole connects the second junction and the second junction electrode.

In the arrangement above, attenuation outside the passband can be greatly increased, since a low-pass filter can be formed by the filter inductor and the filter capacitor that are formed on the spacer and the matching capacitor.

That is, without modifying the outline dimensions of the nonreciprocal circuit device, the filter inductor, the filter capacitor, and the matching capacitor which form a low-pass filter can be built in the device. Since a C-L-C connection Pi-type low pass filter is formed by using the filter inductor, the filter capacitor, and the matching capacitor, the nonreciprocal circuit device of the present invention can contribute to a substantial reduction of extraneous radiation emissions, without the use of an extra filter, which was conventionally necessary for reducing such radiation emissions.

Other features and advantages of the invention will be understood from the following detailed description of an embodiment thereof, in which like references denote like elements and parts.

DESCRIPTION OF AN EMBODIMENT OF THE INVENTION

Figure 1:
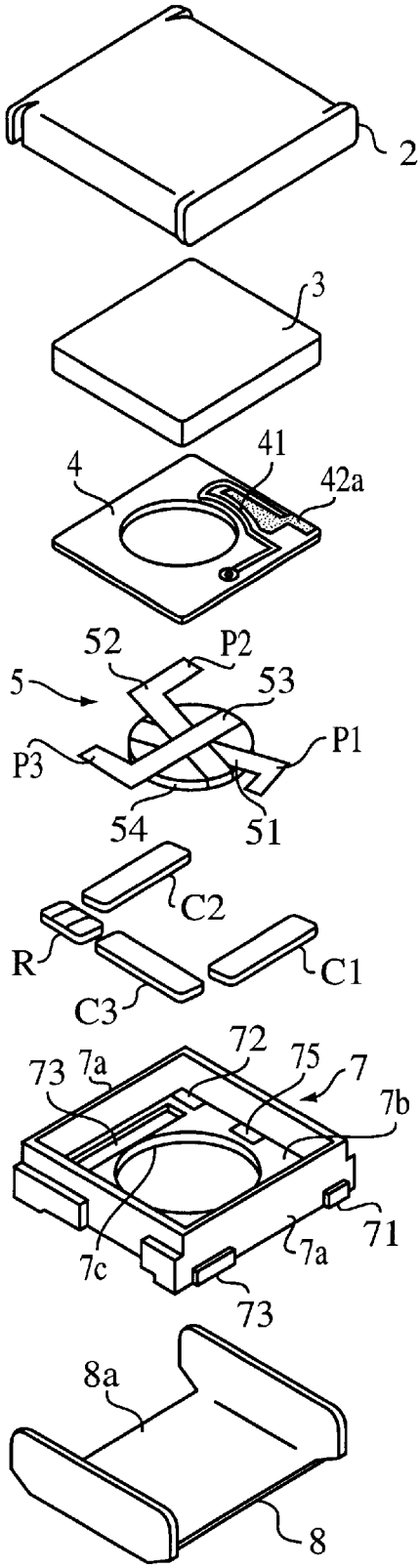
FIG. 1 is an exploded perspective view of an isolator according to a preferred embodiment of the present invention.

Referring now to the drawings, a description will be made of an embodiment of the present invention.

Figure 2:
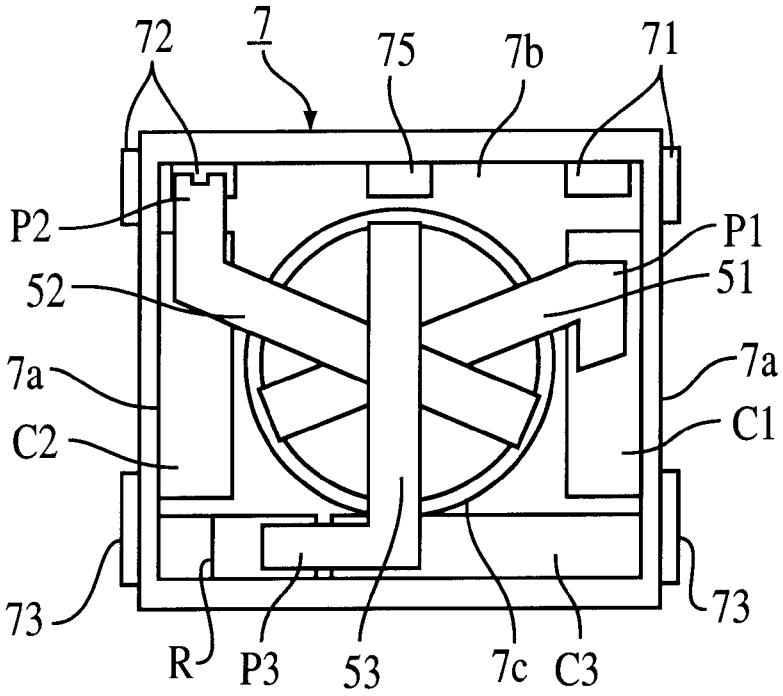
FIG. 2 is a plan view of the isolator employed in the embodiment of the present invention.
Figure 3A:
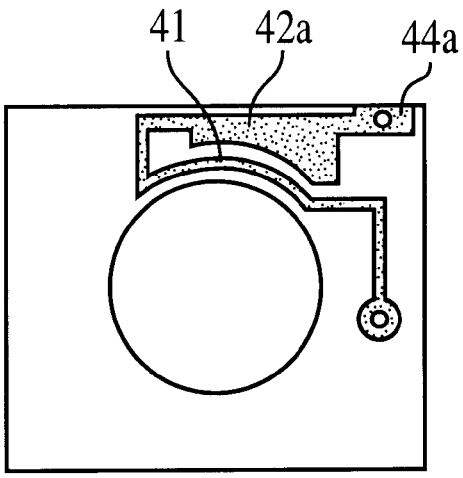
FIGS. 3A and 3B are a plan view of a spacer employed in the embodiment of the present invention.
Figure 3B:
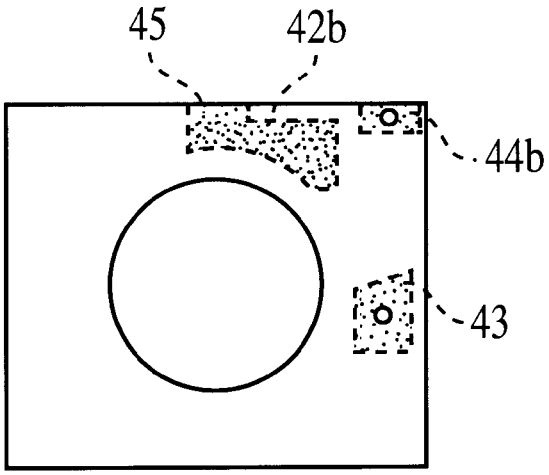
Figure 4:
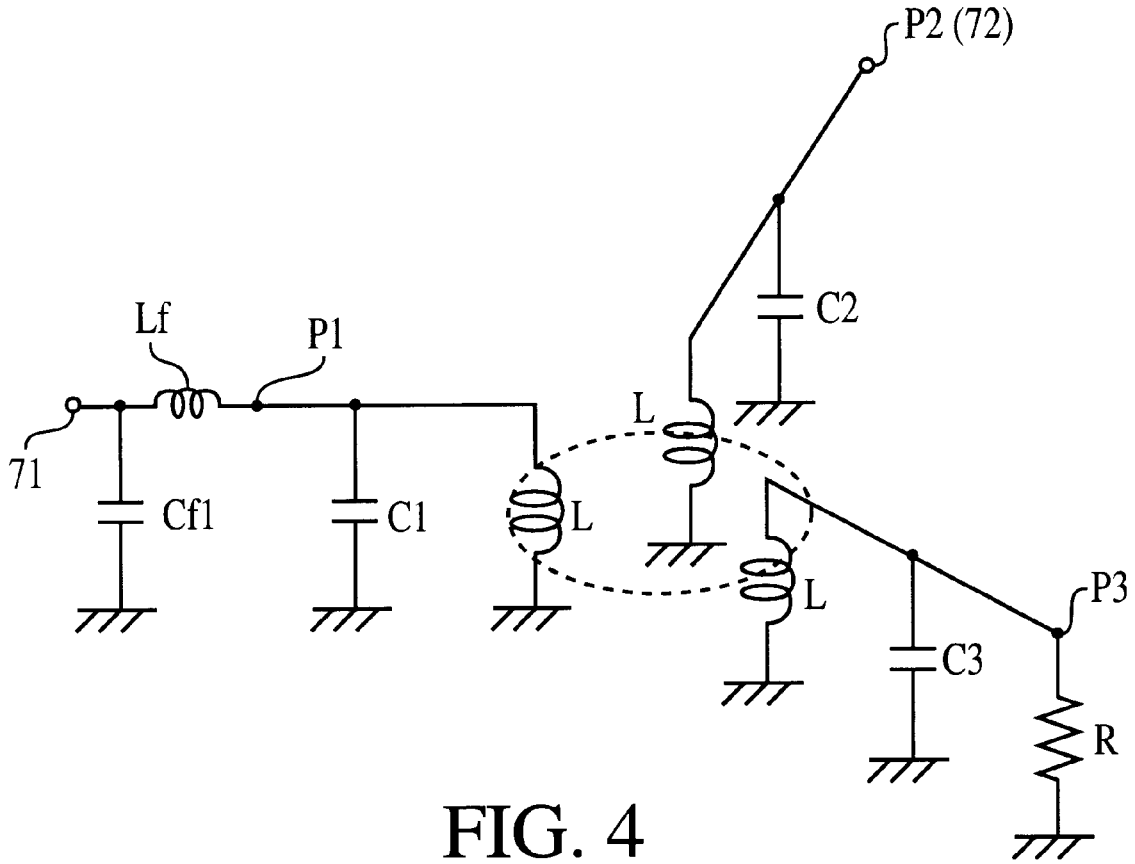
FIG. 4 is an equivalent circuit diagram of the isolator employed in the embodiment of the present invention.

FIGS. 1 to 4 show a structure and an arrangement of an isolator according to an embodiment of the present invention. FIG. 1 is an exploded perspective view of the isolator; FIG. 2 is a plan view of the isolator, in which a spacer, a permanent magnet, and an upper yoke are removed; FIG. 3A is a plan view showing a front surface (an upper side) of the spacer, and FIG. 3B is a plan view showing the back surface (a lower side); and FIG. 4 is an equivalent circuit diagram.

As shown in FIGS. 1 to 3B the isolator employed in the embodiment has an arrangement such that a permanent magnet 3 is disposed on an inner surface of an upper yoke 2 in a box shape, which is formed of a magnetic metal; the yoke 2 is fitted into a substantially U-shaped lower yoke 8, which is similarly formed of a magnetic metal, so as to form a magnetic closed circuit; a resin case 7 is disposed on a bottom surface 8*a* inside the lower yoke 8; a magnetic assembly 5, matching capacitors C1 to C3, and a terminal resistor R are disposed in the resin case 7; a spacer 4 in square-plate form is disposed between the permanent magnet 3 and the magnetic assembly 5; and a DC magnetic field is applied to the magnetic assembly 5 by the permanent magnet 3.

The spacer 4 is formed of a glass-epoxy resin, plastic or Teflon printed circuit board; a ceramic circuit board; or a liquid-crystal-polymer resin plate on which electrodes are formed by press-contacting, printing or the like, or in which a metallic plate is insert-molded. The spacer is used to stably fix the components disposed inside the isolator by filling in the space inside the device and using the elasticity of the spacing member. A through-hole is arranged at the center part corresponding to the position of the magnetic assembly 5. The through-hole is used for retaining the matching capacitors C1 to C3 and the ends (the ports P1 to P3) of the central conductors 51 to 53, etc., more effectively, but arrangement of the hole is not necessarily required.

According to enlarged views of the spacer shown in FIGS. 3A and 3B, on the surface (the upper side shown in the figure) of the spacer are formed an inductor electrode 41 and a capacitor electrode 42*a* which comprise a continuous electrode pattern, and a connection portion 44*a* is formed at an end of the capacitor electrode 42*a*. On the back (the lower side shown in the figure) of the spacer are formed a capacitor electrode 42*b* at a position opposing the capacitor electrode 42*a*, a connection electrode 43 at a position corresponding to an end of the inductor electrode, and a connection electrode 44*b* at a position corresponding to the connection portion 44*a* of the capacitor electrode 42*a*. On the capacitor electrode 42*b* is formed a connection portion 45 at a position corresponding to a part connecting the inductor electrode 41 and the capacitor electrode 42*a*. A through-hole connects an end of the inductor electrode 41 and the connection electrode 43, and another through-hole connects the connection portion 44*a* of the capacitor electrode 42*a* and the connection electrode 44*b*, respectively. The inductor electrode 41 is formed in a curved line so as to have a desired inductance value, while the capacitor electrodes 42*a* and 42*b* are formed in specific dimensions and shapes so as to have a desired capacitance value.

The magnetic assembly 5 has a structure in which ground portions of the three central conductors 51 to 53 respectively formed of a thin metallic plate abut on the lower surface of a disk-shaped ferrite member 54; and the three central conductors 51 to 53 are folded on the upper surface of the ferrite member 54 with insulation sheets interleaved therebetween (not shown) so as to form angles of 120° with respect to each other. The ports P1 to P3, which are the ends of the central conductors 51 to 53, are arranged in such a manner that they extend outwardly.

The resin case 7, which is formed of an electrically-insulated member, has a structure in which a side wall 7*a* in rectangular-frame form is integrated on a bottom wall 7*b*. In this arrangement, certain parts of input/output terminals 71 and 72, certain parts of ground terminals 73 and certain parts of metallic conductive piece 75 are embedded in the resin of the case; a through-hole 7*c* is formed substantially at the center of the bottom wall 7*b*; in the periphery of the through-hole 7*c* recesses are formed at predetermined places for containing the matching capacitors C1 to C3 and the terminal resistor R; the input/output terminals 71 and 72 are respectively disposed at both corners on one side of the resin case 7 in such a manner that ends of the respective terminals are exposed on the upper surface of the bottom wall 7*b*, while the other ends of the terminals are exposed on the lower surface of the bottom wall 7*b* and the outer surface of the side wall 7*a*. In addition, the two ground terminals 73 are arranged on the other side of the resin case 7, and the respective ends of the terminals 73 are exposed on the inner surface of the recess of the bottom wall 7*b*, where the matching capacitors C1 to C3 and the terminal resistor R are arranged, while the other respective ends of the terminals 73 are exposed on the lower surface of the bottom wall 7*b* and the outer surface of the side wall 7*a*. The metallic conductive piece 75 is arranged at substantially a midpoint between the input/output terminals 71 and 72, and an end of the conductive piece 75 is exposed on the upper surface of the bottom wall 7*b*, while the other end of the conductive piece 75 is exposed on the lower surface of the bottom wall 7*b* to abut on the bottom surface 8*a* of the lower yoke 8 so as to be connected to ground.

In the recesses formed in the periphery of the through-hole 7*c* are arranged the chip capacitors C1 to C3 for matching and the chip resistor R for termination; the magnetic assembly 5 is inserted in the through-hole 7*c*; and the spacer 4 is arranged in such a manner that it covers the entire upper part of the magnetic assembly 5.

The ground portions of the central conductors 51 to 53 disposed on the lower surface of the magnetic assembly 5 are connected to the bottom surface 8*a* of the lower yoke 8; the lower-surface electrodes of the matching capacitors C1 to C3 and the electrode on an end of the terminal resistor R are connected to the ground terminals 73, respectively; and the upper-surface electrodes of the matching capacitors C1 to C3 are connected to the ports P1 to P3 of the central conductors 51 to 53, respectively, while the other end of the terminal resistor R is connected to the port P3.

The connection electrode 43 connected to the inductor electrode 41 by the through-hole is connected to the port P1 of the central conductor 51 or the upper-surface electrode of the matching capacitor C1; the connection electrode 44*b* connected to the capacitor electrode 42*a* by the through-hole is connected to the input/output terminal 71; and the connection portion 45 formed on the capacitor electrode 42*b* is connected to the metallic conductive piece 75.

When the upper yoke 2 is fitted into the lower yoke 8, the permanent magnet 3 and the spacer 4 press and fix the magnetic assembly 5 and the resin case 7 into the lower yoke 8; the matching capacitors C1 to C3 and the terminal resistor R into the corresponding recesses of the resin case 7; and the ports P1 to P3 of the central conductors 51 to 53 onto the matching capacitors C1 to C3 and the terminal resistor R.

The isolator in this embodiment, as shown in the equivalent circuit diagram of FIG. 4, has an arrangement in which an inductor Lf formed by the inductor electrode 41 is connected between the port P1 of the central conductor 51 and the input/output terminal 71 through the capacitor electrode 42*a*, while a capacitor Cf1 formed by the capacitor electrodes 42*a* and 42*b* is connected between the input/output terminal 71 and the metallic conductive piece 75 which is connected to ground. Specifically, the inductor Lf has a value obtained by adding the inductance value of the inductor electrode 41 to the inductance value of the capacitor electrode 42*a*; however, the capacitor electrode 42*a* is preferably formed as wide as possible in order to have a negligible inductance value.

In the arrangement of the isolator described in the embodiment, the ports P1 to P3 which are the ends of the central conductors 51 to 53 are connected to the matching capacitors C1 to C3; the port P3 is connected to the terminal resistor R; a filter inductor filter Lf is connected between the input/output port P1 and the input/output terminal 71; and a filter capacitor Cf1 is connected between the input/output terminal 71 and ground. As a result, at one input/output port is arranged a Pi-type low-pass filter comprising the matching capacitor C1, the filter inductor Lf, and the filter capacitor Cf1.

Figure 5:
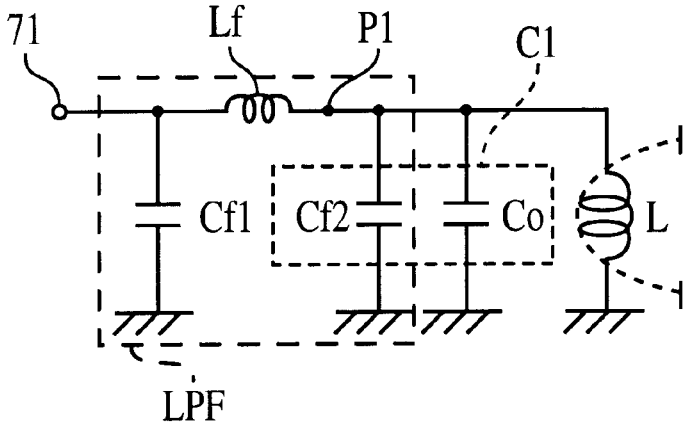
FIG. 5 is a circuit diagram for illustrating an operation of the isolator employed in the embodiment of the present invention.

Next, a description will be given of advantages of the isolator employed in the embodiment. FIG. 5 is a circuit diagram for illustrating the operation of the isolator described above.

As shown in FIG. 5, the matching capacitor C1 of the port P1 is represented by a parallel connection of the capacitor Co serving originally as a matching circuit in the isolator and the filter capacitor Cf2 serving as one of the capacitors in the Pi-type low-pass filter. The combined use of the filter capacitor Cf2, the filter inductor Lf, and the filter capacitor Cf1 achieves an arrangement in which the port P1 is connected to a C-L-C connection Pi-type low-pass filter. In other words, the value of the matching capacitor C1 of the isolator adopted in the embodiment is obtained by adding the value of the filter capacitor Cf2 forming the Pi-type low-band pass filter LPF described above, to the value of the matching capacitor Co serving as a matching circuit of the isolator. For example, in the 1.5 GHz band, the value of the matching capacitor Co is approximately 5 pF, the filter capacitors Cf1 and Cf2 are approximately 2 pF, and the filter inductor Lf is approximately 6 nH, respectively; in the 900 MHz band, the value of the matching capacitor Co is approximately 10 pF, the filter capacitors Cf1 and Cf2 are approximately 3 pF, and the filter inductor Lf is approximately 6 nH, respectively.

In general, the filter capacitors Cf1 and Cf2 are set to the same value so that an input/output impedance (usually, 50

Ω) of the isolator may not change. Accordingly, by setting the filter capacitors Cf1 and Cf2 to different values, the input/output impedance of the isolator can be changed.

The filter inductor Lf and the filter capacitor Cf1 are set to desired values by modifying the width, configuration, etc., of the electrode patterns of the inductor electrode 41 and the capacitor electrodes 42*a* and 42*b* formed on the spacer 4.

Figure 6:
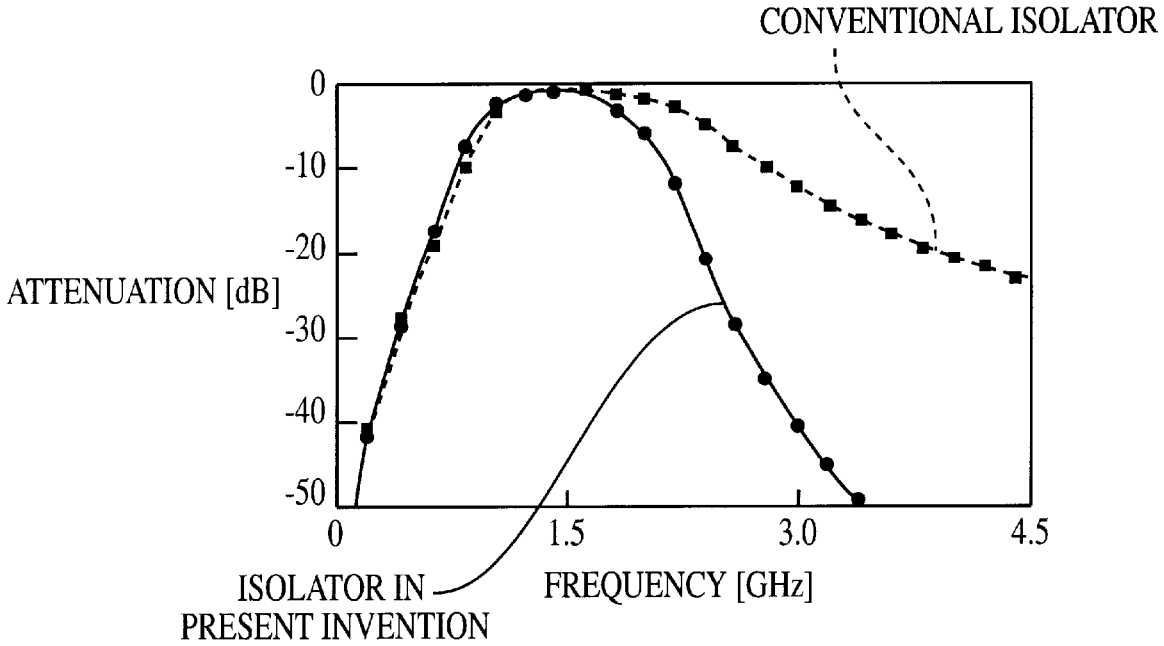
FIG. 6 is a chart indicating respective frequency characteristics of a conventional isolator and the isolator according to the embodiment of the present invention.
Figure 7:
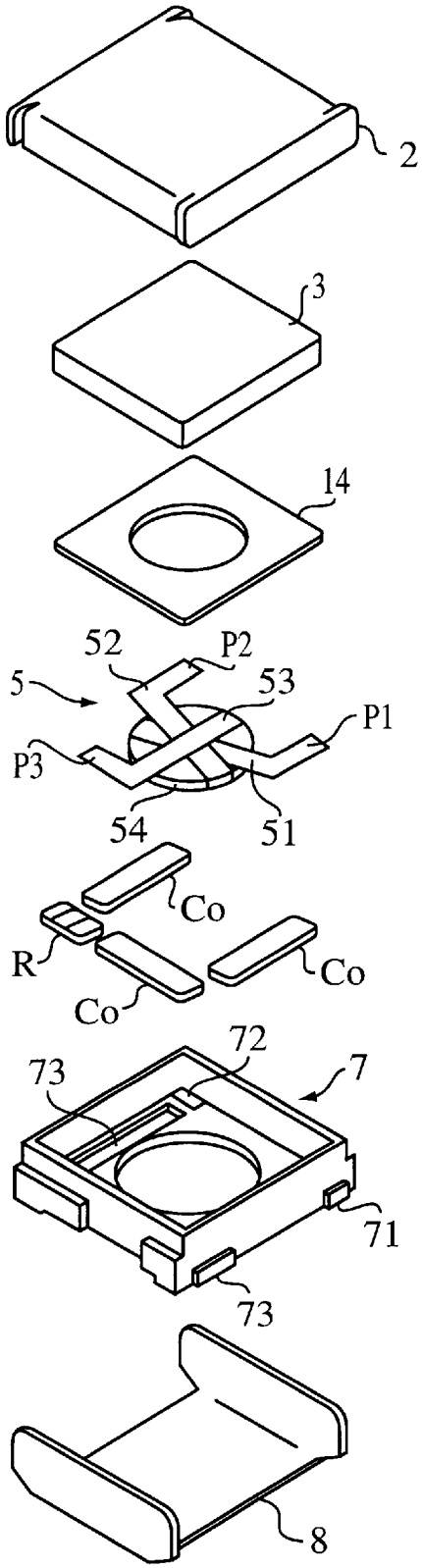
FIG. 7 (PRIOR ART)
FIG. 7 is an exploded perspective view of the conventional isolator.
Figure 8:
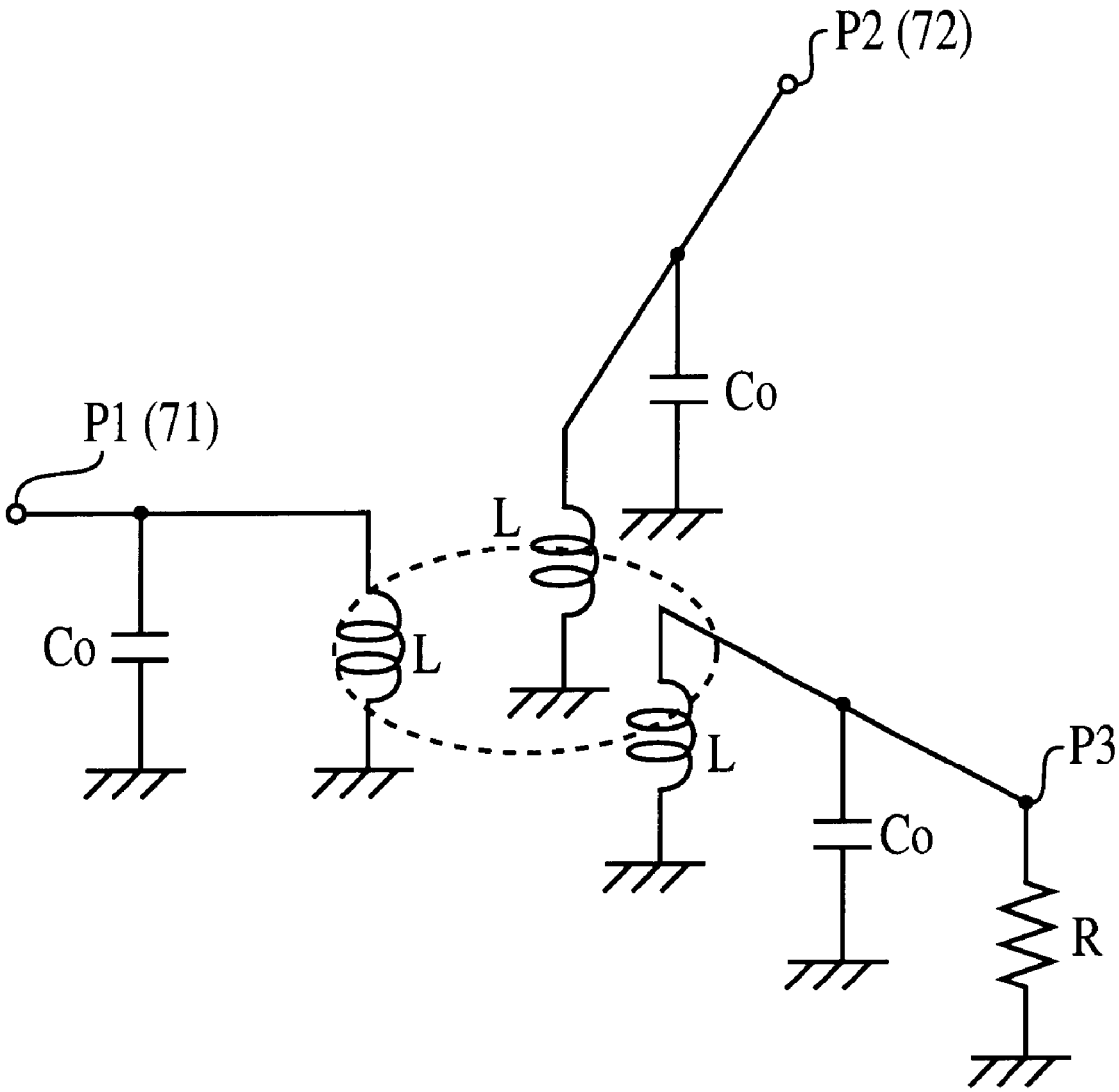
FIG. 8 (PRIOR ART)
FIG. 8 is an equivalent circuit diagram of the conventional isolator.

FIG. 6 is a chart showing a frequency versus attenuation characteristic of the isolator of the embodiment and of the conventional isolator. In this chart, the solid line shows a characteristic of the isolator used in the embodiment, whereas the broken line shows a characteristic of the conventional isolator. As shown in the figure, compared to the conventional type, it is clear that the isolator of the embodiment permits greatly increased attenuation in a high-frequency band.

As described above, in the isolator of the embodiment, the filter inductor Lf and the filter capacitor Cf1 are formed on the spacer 4; and at a signal input/output section corresponding to the port P1, a Pi-type low pass filter LPF is formed which comprises the filter inductor Lf, the filter capacitor Cf1, and the matching capacitor C1. Accordingly, as shown in FIG. 6, in this isolator much more attenuation can be provided outside a passband than in the conventional isolator.

The filter inductor Lf and the filter capacitors Cf1 and Cf2 forming the low-pass filter LPF are incorporated in the isolator of the embodiment without making its outline dimensions larger than those of the conventional isolator. Thus, without adding another filter, which was previously necessary to block extraneous radiation emissions, and without having to separately form a pattern of electrodes, etc., to be used for a filter on a mounting substrate, a large reduction in extraneous radiation emissions can be achieved, so that the isolator of the present invention can contribute to miniaturization and cost reduction of communication equipment.

The pattern shapes of the spacer 4, the inductor electrode 41, and the capacitor electrodes 42*a* and 42*b* should not be restricted to those of the embodiment above. The spacer 4 may not be a flat-plate shape; it may have a recess and a protrusion for press-fixing the components more tightly and reliably. Furthermore, the pattern of electrodes may be produced by forming the filter inductor Lf and the filter capacitor Cf1 completely or partially inside the spacer, the spacer being composed of multiple layers.

FIGS. 9A, 9B, 9C and 10 show enlarged views of a spacer 90 which is a modification of the spacer 4.

Figure 9A:
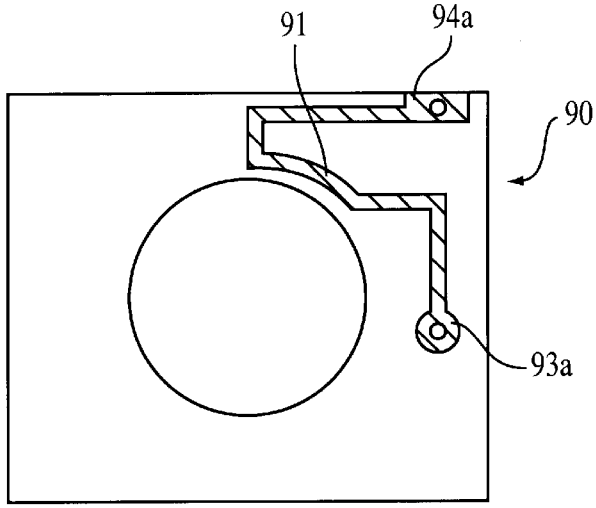
FIG. 9A is a plan view of an upper side of a first layer of a multilayer spacer according to another embodiment of the invention, this embodiment having filter electrodes disposed inside the multilayer spacer.

On an upper side of a first layer of the spacer 90, shown in FIG. 9A, an inductor electrode 91 is formed. The inductor electrode 91 is extended to a first connection portion 93*a* at one end thereof and to a second connection portion 94*a* at the other end thereof.

Figure 9B:
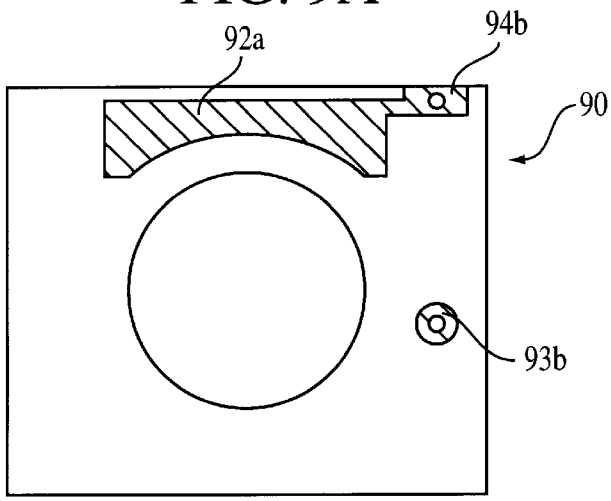
FIG. 9B is a plan view of an upper side of a second layer of the spacer of FIG. 9A.
Figure 9C:
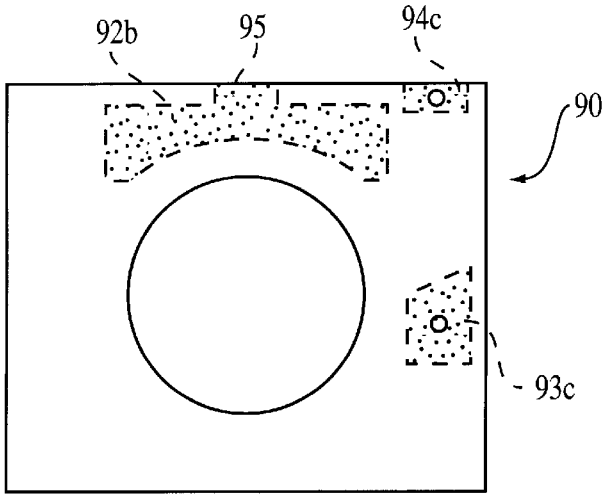
FIG. 9C is a plan view of a lower side of the second layer.
Figure 10:
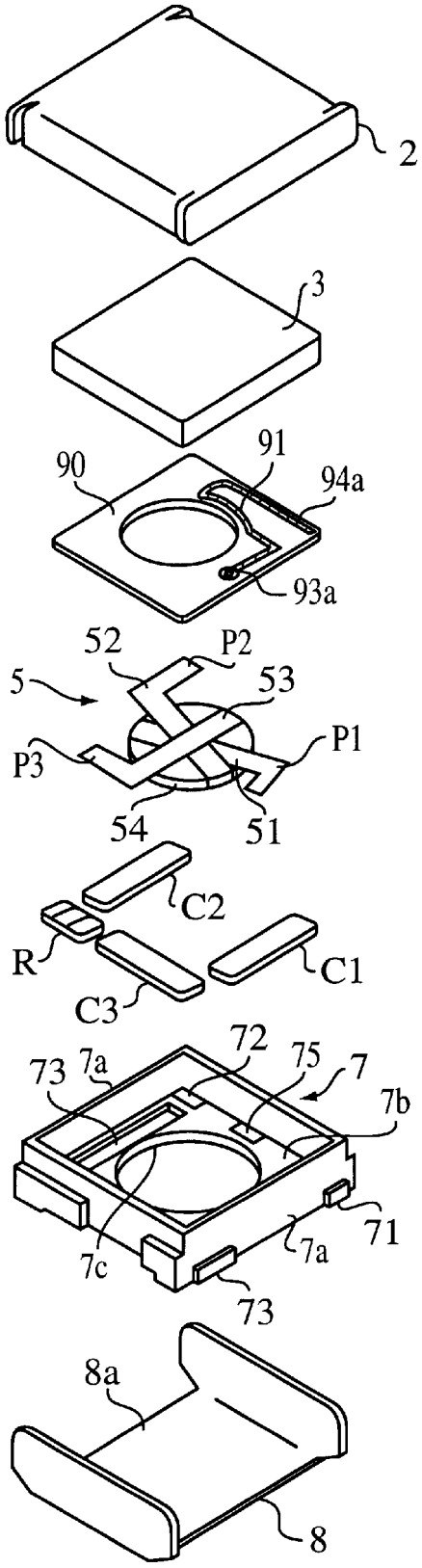
FIG. 10 is an exploded perspective view of an isolator according to another embodiment of the invention, employing the spacer shown in FIGS. 9A, 9B and 9C.

On an upper side of a second layer of the spacer 90, shown in FIG. 9B, are formed a capacitor electrode 92*a* and a third connection portion 93*b* connected to the first connection portion 93*a* by a through-hole. The capacitor electrode 92*a* is extended to a fourth connection portion 94*b* connected to the second connection portion 94*a* by another through-hole. On a lower side of the second layer shown in FIG. 9C, a capacitor electrode 92*b*, which is formed at a position opposing the capacitor electrode 92*a*, links to a fifth connection portion 95. A sixth connection portion 94*c* is connected to the fourth connection portion 94*b*. A connection electrode 93*c* is connected to the third connection portion 93*b*.

Thus, the connection electrode 93*c*, connected to the inductor electrode 91 by the through-hole, is connected to the port P1 of the central conductor 51 or the upper-surface electrode of the matching capacitor C1; the sixth connection portion 94*c* connected to the capacitor electrode 92*a* by the through-hole is connected to the input/output terminal 71; and the fifth connection portion 95 formed on the capacitor electrode 92*b* is connected to the metallic conductive piece 75.

Although the low-pass filter is formed at only one of the signal input/output ports in the isolator of the embodiments, the filter may also be formed at both input/output ports of the isolator.

Moreover, although the disclosed embodiments relate to an isolator, a circulator can be provided, if no terminal resistor R is connected to the port P3. In such a circulator, the port P3 is arranged as a third input/output terminal.

In addition, the overall structure and features of the device should not be restricted to those of the embodiments; other structures and features may be possible, so long as there is provided a nonreciprocal circuit device having the novel features disclosed herein, including modifications and variations that might occur to one having the ordinary level of skill in the art.

As described above, according to the nonreciprocal circuit device of the present invention, the filter inductor and the filter capacitor are formed on or in the spacer; whereby the low-pass filter can be formed by the combination of the filter inductor, the filter capacitor, and the matching capacitor. This arrangement achieves a large increase in attenuation outside a passband.

In other words, the filter inductor and the filter capacitor forming the low-pass filter can be formed in the nonreciprocal circuit device without modifying the outline dimensions of the device; and the low-pass filter can be formed by the filter inductor, the filter capacitor, and the matching capacitor. Thus, the nonreciprocal circuit device provided by the present invention makes it unnecessary to use an additional filter to block extraneous radiation emissions, thereby facilitating miniaturization and cost reduction of communication equipment.

What is claimed is:

1. A nonteciprocal circuit device comprising:

a case;

a magnetic member in the case;

a magnetic assembly in the case having a plurality of central conductors, first ends of said central conductors being disposed on the magnetic member so as to mutually intersect and being adapted to receive a DC magnetic field applied thereto, second ends of said central conductors defining corresponding ports;

a plurality of matching capacitors connected respectively between said ports of said central conductors and a ground; and a spacer for stably supporting at least the magnetic assembly and the matching capacitors in the case;

wherein the spacer includes filter electrodes providing a filter inductor and a filter capacitor; the filter inductor is connected between the port of at least one of the central conductors and an input/output terminal corresponding to the port; the filter capacitor is connected between said input/output terminal and said ground; whereby a low-pass filter is formed by the filter inductor, the filter capacitor, and the matching capacitor.

2. A nonreciprocal circuit device comprising:

a magnetic circuit comprising a permanent magnet disposed in a yoke;

a magnetic member;

a magnetic assembly disposed in the magnetic circuit and having a plurality of central conductors, first ends of said central conductors being disposed on the magnetic member so as to mutually intersect, second ends of said central conductors defining corresponding ports;

a plurality of matching capacitors connected respectively between said ports of said central conductors and a ground terminal;

a case containing the magnetic assembly and the matching capacitors and having an input/output terminal and said ground terminal; and a spacer for stably supporting at least the magnetic assembly and the matching capacitors in the case;

wherein the spacer includes filter electrodes providing a filter inductor and a filter capacitor; the filter inductor is connected between the port of at least one of the central conductors and said input/output terminal; the filter capacitor is connected between said input/output terminal and said ground terminal; whereby a low-pass filter is formed by the filter inductor, the filter capacitor, and the matching capacitor.

3. A nonreciprocal circuit device according to claim 1 or claim 2, wherein said filter electrodes providing the filter inductor and the filter capacitor are formed on an outer surface of the spacer.

4. A nonreciprocal circuit device according to claim 3, wherein said filter electrodes are formed on two opposite outer surfaces of said spacer.

5. A nonreciprocal circuit device according to claim 1 or claim 2, wherein said filter inductor and said capacitor are connected to the port of only said one of said central conductors.

6. A nonreciprocal circuit device according to claim 1 or claim 2, wherein said central conductors are disposed outside an outer surface of the magnetic member.

7. A nonreciprocal circuit device according to claim 6, wherein said central conductors are disposed adjacent to said outer surface of the magnetic member.

8. A nonreciprocal circuit device according to claim 1 or claim 2, wherein said filter electrodes are disposed at least partially inside the spacer.

9. A nonreciprocal circuit device according to claim 8, wherein said filter electrodes are formed both inside said spacer and on an outer surface of said spacer.

10. A nonreciprocal circuit device according to claim 8, wherein said spacer has a plurality of layers and said filter electrodes are formed on at least two of said layers.

11. A nonreciprocal circuit device according to claim 10, wherein said filter electrodes are formed both inside said spacer and on an outer surface of said spacer.

12. A nonreciprocal circuit device according to claim 10, wherein said filter capacitor is formed on said at least two of said layers.

13. A nonreciprocal circuit device according to claim 8, wherein said filter capacitor is formed at least partially inside said spacer.

* * * * *